US005488774A

United States Patent [19]

Janowski

[11] Patent Number: 5,488,774

[45] Date of Patent: Feb. 6, 1996

[54] CUTTING EDGES

[76] Inventor: Leonard J. Janowski, 1-1 S. Meadow Village, Carver, Mass. 02330

[21] Appl. No.: 152,907

[22] Filed: Nov. 15, 1993

Related U.S. Application Data

[63] Continuation-in-part of Ser. No. 901,696, Jun. 22, 1992, abandoned, which is a continuation of Ser. No. 620,761, Dec. 3, 1990, abandoned, which is a continuation-in-part of Ser. No. 469,312, Jan. 24, 1990, abandoned.

[51] Int. Cl.[6] ..... B26B 21/54

[52] U.S. Cl. ..... 30/346.53; 30/346.55

[58] Field of Search ..... 30/346.54, 346.53, 30/346.55, 346.58; 427/53.1, 248.1, 249, 356, 355, 38, 377; 204/192.15, 192.3

[56] References Cited

U.S. PATENT DOCUMENTS

| | | | |
|---|---|---|---|
| 3,761,372 | 9/1973 | Sastri | 30/346.55 |
| 4,839,195 | 6/1989 | Kitamura et al. | 427/38 |
| 4,933,058 | 6/1990 | Bache et al. | 204/192.3 |
| 4,948,629 | 8/1990 | Hacker et al. | 427/53.1 |

*Primary Examiner*—Hwei-Siu Payer

[57] ABSTRACT

An improved cutting instrument including a wedge-shaped cutting edge such as a razor blade having in the region of its ultimate edge an adherent low friction coating of diamond or a diamondlike carbon.

17 Claims, 1 Drawing Sheet

CUTTING EDGES

BACKGROUND OF THE INVENTION

This application is a continuation-in-part of application Ser. No. 901,696, filed Jun. 22, 1992, now abandoned which was a continuation of application Ser. No. 620,761, filed Dec. 3, 1990, also abandoned which was a continuation-in-part of application Ser. No. 469,312 filed Jan. 24, 1990, also abandoned.

The present invention relates to cutting instruments employing wedge-shaped cutting edges such as axes, knives, chisels and especially, razor blades, said cutting edges being coated with a novel, low friction coating.

The formation of cutting edges on razor blades conventionally involves a series of grinding and honing operations to produce a sharp and relatively durable shaving edge. Each grinding operation forms a facet on the blade edge being sharpened, which facet is modified by subsequent grinding operations of increasing fineness. Generally, the finished blade edge is wedge-shaped having an included solid angle of about 14°–35°, the preferred wedge angle being between about 18°–26°. The faces or sides of the cutting edges may extend back from the ultimate edge a distance of up to 0.1 inch or even more. Each face is typically made up of two or more facets formed by the successive grinding and honing operations recited above. The final facet, i.e. the facet immediately adjacent the ultimate edge has a width as low as 7.5 microns or even less compared to the diameter of beard hair which ranges from 100–125 microns. The steel of which the blade edge is composed may be either carbon steel or stainless steel. In either case it is hardened by a suitable process, as by heat treating or working. There is a limit to the extent to which the blade subsequently may be heated since excessive reheating will lead to loss of hardness. As a general rule the heat-hardened metal blade edges cannot be subjected to a temperature above about 400° F. for more than five minutes without some tempering or softening, although work-hardened blade edges can withstand considerably higher temperatures. In some cases, however, particularly with stainless steel, some softening or tempering of the blades can be tolerated since its disadvantages are more than offset by the improvement in shaving effectiveness produced by the present invention.

For purposes of this invention a cutting edge is described as being "metallurgically intact" whenever, subsequent to the hardening process, such edge has not been subjected to a temperature above about 400° F. for more than about five minutes.

During the honing of the final facet, deflection of the steel blade Strip in the sharpening machine together with the mechanical interaction between the steel and the abrasive particles of the grinding wheel produce a final facet which is usually not planar but slightly convex. The curvature is a function of the type of steel and grinding wheel employed, as well as the setting parameters of the sharpening machine. Because of the resulting convexity of the final facets on each side of the blade, the blade tip cross section of the ultimate edge is customarily referred to as "Gothic arched". Through shave test evaluation and measurement of the geometry of such sharpened cutting edges, it has been found that the ultimate edge should have an average tip radius of less than about 500 angstroms. Typically, a shave facilitating layer of an organic polymeric material is applied to the area of the blade adjacent the ultimate edge.

During shaving, a razor blade is held in the razor at an angle of about 25° and, with the edge in contact with the skin, is moved over the face. When the edge encounters a beard hair, it enters and severs it by progressive penetration aided by a wedging action of the wedge-shaped blade cutting surface. It is believed that the cut surfaces of each beard hair remain pressed in contact with the facets of the blade edge during the cutting process until the fiber is cut about one half through. At that point, the fiber can bend in the direction of blade edge travel to partially relieve the wedging forces. In spite of this, the binding or frictional forces between the blade cutting edge surfaces and the surfaces of the partially cut beard hairs contribute significantly to the overall resistance to cutting in the shaving process which translates directly to shaving discomfort.

As mentioned above, a shave facilitating layer of an organic polymeric material is typically applied to coat the cutting edges of razor blades for the purpose of increasing shaving comfort and useful blade life. This coating may take the form of (1) a partially cured polysiloxane coating as described in U.S. Pat. No. 2,937,967; (2) a polyolefin coating as described in U.S. Pat. No. 3,071,858, or a polyfluorocarbon coating such as the ones described in U.S. Pat. No. 3,071,856. The formation of these shave facilitating coatings and others are fully described in the above, as well as other, patents.

While it is true that the application of such organic polymeric coatings to razor blade edges results in improved first shave comfort and increased blade life as compared to uncoated blades, effectiveness diminishes with each succeeding shave due to deterioration of the coating and ultimate blade edge. There is, accordingly, a need for an improved edge coating which will facilitate shaving and further improve the useful life of steel razor blades and the edges of other types of cutting instruments.

DETAILED DESCRIPTION OF THE INVENTION AND BEST MODE

According to the present invention there is provided a sharpened steel razor blade having, in the region of its ultimate edge, an adherent, low friction, shave facilitating coating of diamond or a diamondlike material.

Several vapor deposition techniques are known for the purpose of forming vapor deposited coatings of diamond or diamondlike compounds on substrates in a variety of applications such as bearing surfaces resistant to heat and corrosion, extra-hardened windows, heat sinks for electronic devices, cutting tool inserts and high speed electronic components. One such diamond-growing method involves shining intense, brief pulses of laser light on the surface of a block of very pure graphite. The laser vaporizes the surface material, cutting a crater while explosively sending out a high-temperature plume containing ionized carbon atoms. An electric field guides the charged particles to the surface to be coated. Each laser pulse, lasting only 10 nanoseconds, lays down a single layer of atoms. The resulting transparent film, about 200 angstroms thick, has a mirror-smooth finish.

In another method a mixture of methane or other hydrocarbon and hydrogen is converted to a plasma above a substrate to be coated by heating the gas with a hot filament, microwave radiation or an oxygen-acetylene torch. The carbon in the gas mixture condenses onto the relatively cooler substrate. More active forms of carbon which may be present, such as graphite, tend to react with atomic hydrogen leaving a diamond coating.

A method of depositing diamond films on substrates at relatively low temperatures involves the use of a high powered, pulsed laser. In practice, a substrate to be coated is confined in an enclosed space at, for example, room temperature in a vapor of a compound such as an aliphatic carboxylic acid or an aromatic carboxylic anhydride. The vapor is then irradiated with the laser which strikes the substrate, depositing a diamond film on the areas struck by the laser radiation. The process is especially useful in the practice of the present invention in providing improved control of the area and thickness of deposit of the various carbon species on the hardened steel blade substrate at temperatures of less than 400° F.

These vapor deposition techniques are well known in the art. Many are described in greater detail in a paper entitled "Low-pressure, Metastable Growth of Diamond and 'Diamondlike' Phases" (John C. Angus and Cliff C. Hayman; Science, Aug. 19, 1988: pp. 913–921) as well as in many of the references cited therein.

Other prior art references describing vapor deposition techniques include:

U.S. Pat. No. 4,933,058 which describes a process for coating razor blade edges by electron beam evaporation of a coating material.

U.S. Pat. No. 4,948,629 which describes a process in which diamond films are deposited on substrates below temperatures of 400° C. by chemical vapor deposition using a high powered, pulsed laser and a vapor which is an aliphatic carboxylic acid or an aromatic carboxylic anhydride.

U.S. Pat. No. 4,954,365 in which a thin diamond film is prepared by immersing a substrate in a liquid containing carbon and hydrogen and then subjecting the substrate to pulses from an eximer laser.

U.S. Pat. No. 4,816,291 which discloses a process and apparatus for the production of diamond films at high rates from an activated reactive vapor phase containing carbon and hydrogen in the presence of plasma to form diamond precursors, which deposit on a substrate.

U.S. Pat. No. 4,434,188 which describes the chemical vapor deposition of carbon atoms onto a substrate in a chamber employing a high energy plasma generated by the discharge of electrical energy across electrodes in the presence of a hydrocarbon and hydrogen.

U.S. Pat. No. 4,504,519 which discloses the use of RF energy to effect the plasma decomposition of an alkane to form an amorphous carbonaceous film on a substrate with film thicknesses of 0.08–2.75 microns.

U.S. Pat. No. 4,490,229 which discloses a process in which a carbon film is deposited onto a substrate by means of two argon beams containing hydrogen and the other carbon atoms.

U.S. Pat. No. 4,816,286 which discloses a process for depositing diamond on a substrate by converting an organic compound containing carbon, hydrogen and oxygen or nitrogen to a gas phase which is mixed with hydrogen gas and the compound decomposed by exposure to a source of thermal, electrical or electron energy.

U.S. Pat. No. 4,859,490 which discloses a method and apparatus for synthesizing diamond film employing a low-pressure vapor phase comprising a carbon source, a hydrocarbon, and carbon tetrachloride and mixed with hydrogen.

U.S. Pat. No. 4,859,493 which discloses an apparatus and method for applying diamond coatings to articles of manufacture while the articles are fluidized in a coating chamber.

Insofar as they pertain to the vapor deposition of diamond or diamondlike coatings, all of the above prior art references are hereby incorporated herein by reference.

DESCRIPTION OF THE DRAWINGS

In FIG. 1, reference numeral 1 represents a device for supplying an organic compound and hydrogen, reference numeral 2 represents a heating furnace, reference numeral 3 represents a substrate supporting stand, reference numeral 4 represents reaction tube, reference numeral 5 represents a substrate, reference numeral 6 represents a tungsten filament, reference numeral 7 represents an exhaust apparatus, reference numeral 8 represents an exhaust opening, and each of reference numerals 9, 10, 11 and 12 represents a cock.

Figure 1:
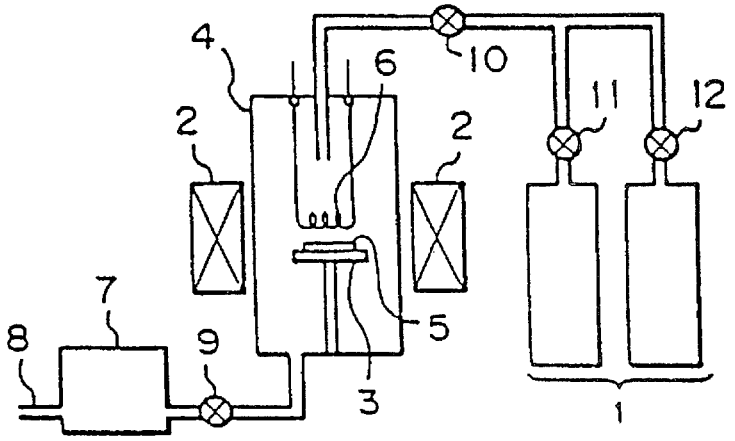
FIGS. 1–4, taken from reference Pat. No. 4,816,286; described hereinabove, illustrate an example of one type of apparatus for forming a diamond or diamondlike coating on a steel cutting edge substrate as set forth in the Examples below.

In operation, substrate 5 is set on the substrate supporting stand 3 in the reaction tube 4, and air in the reaction tube 4 is removed by the exhaust device 7. The concentration and flow rate of the mixed gas are then adjusted by the cocks 10, 11 and 12, the mixed gas is introduced into the reaction tube 4, and the pressure in the reaction tube 4 maintained at a predetermined level by the cock 9. The mixed gas is introduced into the reaction tube 4 from the upper portion and is passed through the tungsten filament 6 located in the vicinity of the substrate supporting stand 3, where the mixed gas is supplied to the surface of substrate 5. The heating furnace 2 and tungsten filament 6 are heated to predetermined temperature.

Figure 2:
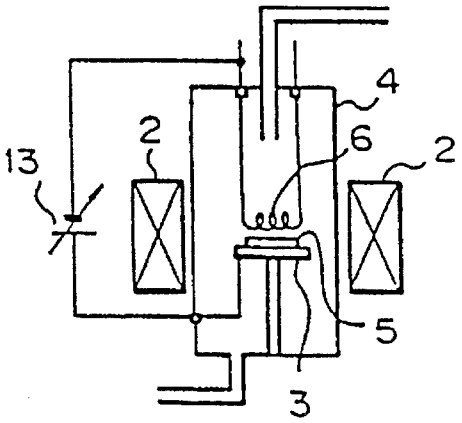
Figure 3:
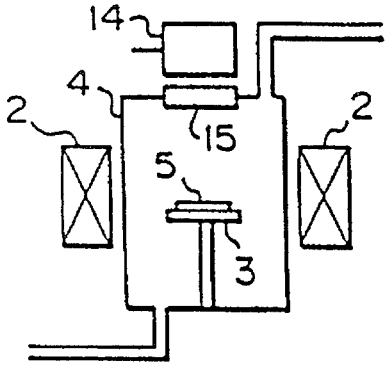
Figure 4:
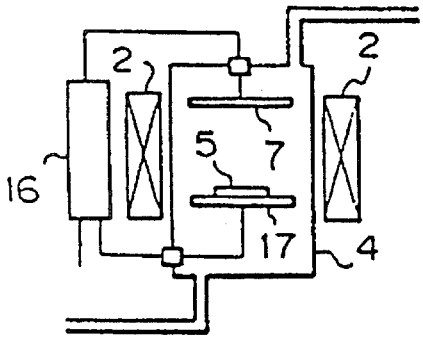

FIG. 2 illustrates the surrounding portion of the reaction tube 4, the other portion is omitted. In FIG. 2, reference numeral 13 represents a direct current power source for generating the electron beam between the tungsten filament 16 and the substrate. The same members as shown in FIG. 1 are represented by the same reference numerals. In FIG. 3, reference numeral 14 represents a light source and reference numeral 15 represents a light transmitting window, and in FIG. 4, reference numeral 16 represents a plasma generating power source while reference numeral 17 represents an electrode.

As mentioned hereinabove, the vapor phase deposition of carbon can, depending upon reaction conditions, yield coatings ranging from essentially pure diamond to mixtures containing, in addition to diamond, graphite and a variety of hard intermediate species generally referred to herein and in the prior art as "diamond-like" carbon phases. For many purposes the presence of such non-diamond species is detrimental in that desired properties such as transparency and electrical conductivity are altered. For the purposes of this invention however the presence of substantial quantities of non-diamond carbon species can be tolerated in the blade coating since the various diamondlike carbon phases provide shave enhancing benefits of the same order as diamond. The presence of graphite in the deposited carbon layer is thought to be beneficial in that it can improve adhesion at the carbon-steel interface by reducing differences in the coefficients of thermal expansion. The presence of graphite in the deposited carbon layer is also believed to contribute to the shave facilitating properties of the invention. Only sufficient diamond and diamondlike phases need be present in the coating, about 25% by weight (i.e. up to 75% by weight may be Graphite) to provide coating integrity during the shaving life of the blade.

To avoid the need for resharpening the razor blade of this invention after application of the diamond coating, it is important that the coating thickness be kept to a minimum and should not exceed about 600 angstroms in thickness, a preferred range being about 50–500 angstroms. Best results are obtained with a coating thickness range of about 100–400 angstroms. The coating is preferably continuous and of substantially uniform thickness. To insure that the blade coating is effective in reducing cutting forces during shaving, it should extend back from,the ultimate edge at least about 50 microns and, preferably about 100 microns. In the case of wedge-shaped cutting instruments other than razor blades it may be advantageous to coat substantially more or even all of the blade surfaces.

Where it is desired to reduce the thickness or alter the surface characteristics of the diamond film as deposited, it may be accomplished by conventional working techniques including abrasive grinding and honing. Excess coating material may also be removed by subjecting the cutting edge to ion bombardment with ions of sufficient mass and energy to cause sputter removal as described in U.S. Pat. No. 4,933,058.

A further means for removing excess coating material is by the process of graphitization as described in my U.S. Pat. No. 5,257,564. Whatever process is employed to form a worked surface, it is preferred that the cutting edge not be subjected to a temperature above about 400° F. for more than about five minutes, the edge thus remaining metallurgically intact.

In an alternative form of the invention, diamond coatings of thickness even greater than 600 angstroms may be applied to a steel substrate by vapor deposition and a cutting edge formed wholly in the deposit by, for example, graphitization, conventional grinding and honing techniques or ion bombardment. Since such a process, because of the hardness of the coating, is difficult and time consuming, the substrate should, before coating, be shaped to approximately the final desired cross sectional shape to minimize the amount of coating requiring removal to form the desired edge.

Where it is desired to further improve the adhesion of the diamond or diamond-like layer, the substrate may be provided with a first coating of a material such as chromium, molybdenum or titanium as is well known in the prior art.

As an optional final step in the production of the razor blade of this invention, a conventional organic polymer coating to improve shaving effectiveness of the blade may be applied to the cutting edge. This coating only take the form of a partially cured polysiloxane coating, a polyolefin coating or a polyfluorocarbon coating as described in the prior art recited hereinabove.

The following non-limiting examples illustrate the preparation of improved cutting instruments within the scope of the present invention.

EXAMPLE 1

Using apparatus of the type described in FIGS. 1–4, a conventionally sharpened stainless steel razor blade is employed as a substrate and a gaseous mixture comprising methanol and hydrogen having a volume ratio of 1:100 is used as the reaction gas. The pressure in the reaction tube is adjusted to 50 Torr and the substrate temperature adjusted to 700° C. Deposition is carried out for one minute while the tungsten filament is heated to a temperature of 2,000° C. A diamond or diamondlike deposit about 500 angstroms thick is obtained.

EXAMPLE 2

Using apparatus of the type described in FIGS. 1–4, a conventionally sharpened carbon steel razor blade is employed as a substrate and a gaseous mixture comprising ethanol and hydrogen having a volume ratio of 1:500 is used as the reaction gas. The pressure in the reaction tube is adjusted to 40 Torr and the substrate temperature adjusted to 600° C. Deposition is carried out for one minute while the tungsten filament is heated to a temperature of 2,000° C. A diamond or diamondlike deposit about 800 angstroms thick is obtained.

EXAMPLE 3

Using apparatus of the type described in FIGS. 1–4, a conventionally sharpened carbon steel razor blade is employed as a substrate and a gaseous mixture comprising trimethylamine and hydrogen having a volume ratio of 1:100 is used as the reaction gas. The pressure in the reaction tube is adjusted to 50 Torr and the substrate temperature adjusted to 650° C. Deposition is carried out for one minute while the tungsten filament is heated to a temperature of 2,000° C. A diamond or diamondlike deposit about 500 angstroms thick is obtained.

While particular embodiments of the invention have been described, various modifications thereof will be apparent to those skilled in the art. It is therefore not intended that the invention be limited to the disclosed embodiments or to details thereof and departures may be made therefrom within the spirit and scope of the invention as defined in the claims.

What is claimed is:

1. A cutting instrument including a wedge-shaped, metallurgically intact, steel cutting edge having in the region of its ultimate edge an adherent coating of a material selected from the group consisting of diamond, diamond-like carbon and mixtures thereof, said coating containing in addition, up to 75% by weight graphite.

2. A cutting instrument as claimed in claim 1 in which the thickness of said coating does not exceed about 600 angstroms.

3. A cutting instrument as claimed in claim 1 in which the thickness of said coating is about 100–400 angstroms.

4. A cutting instrument as claimed in claim 1 in which said coating extends back from the ultimate edge at least about 50 microns.

5. A cutting instrument as claimed in claim 1 in which the thickness of said material exceeds 600 angstroms and in which said cutting edge has been formed wholly in said material.

6. A cutting instrument as claimed in claim 1 in which said coating comprises a worked surface bearing an organic polymer coating to improve shaving effectiveness.

7. A cutting instrument including a wedge-shaped, metallurgically intact, steel cutting edge having in the region of its ultimate edge an adherent, laser deposited coating of a material selected from the group consisting of diamond, diamond-like carbon and mixtures thereof, said coating containing in addition, up to 75% by weight graphite.

8. A cutting instrument as claimed in claim 7 in which the thickness of said coating is about 100–400 angstroms.

9. A cutting instrument as claimed in claim 7 in which said coating extends back from the ultimate edge at least about 50 microns.

10. A cutting instrument as claimed in claim 7 in which the thickness of said material exceeds 600 angstroms and in which said cutting edge has been formed wholly in said material.

11. A cutting instrument as claimed in claim 7 in which said coating comprises a worked surface bearing an organic polymer coating to improve shaving effectiveness.

12. A cutting instrument including a wedge-shaped, metallurgically intact, steel edge having in the region of its ultimate edge an adherent, vapor deposited coating of a material selected from the group consisting of diamond, diamond-like carbon and mixtures thereof, said coating containing in addition, up to 75% by weight graphite.

13. A cutting instrument as claimed in claim 12 in which the thickness of said coating does not exceed about 600 angstroms.

14. A cutting instrument as claimed in claim 12 in which the thickness of said coating is about 100–400 angstroms.

15. A cutting instrument as claimed in claim 12 in which said coating extends back from the ultimate edge at least about 50 microns.

16. A cutting instrument as claimed in claim 12 in which the thickness of said material exceeds 600 angstroms and in which said cutting edge has been formed wholly in said material.

17. A cutting instrument as claimed in claim 12 in which said coating comprises a worked surface bearing an organic polymer coating to improve shaving effectiveness.

* * * * *